US007101231B2

(12) United States Patent
Prokup et al.

(10) Patent No.: US 7,101,231 B2
(45) Date of Patent: Sep. 5, 2006

(54) LOCKING SPRING-CLAMP TERMINAL BLOCK AND METHOD FOR CONNECTING THE SAME

(75) Inventors: Ronald Paul Prokup, Ellisville, MO (US); Robert Lewis Newton, Jr., Elgin, IL (US); Jack Wu, Taipei Hsein (TW)

(73) Assignee: Cooper Technologies Company, Houston, TX (US)

( * ) Notice: Subject to any disclaimer, the term of this patent is extended or adjusted under 35 U.S.C. 154(b) by 12 days.

(21) Appl. No.: 10/959,814

(22) Filed: Oct. 6, 2004

(65) Prior Publication Data

US 2005/0079773 A1 Apr. 14, 2005

Related U.S. Application Data

(60) Provisional application No. 60/509,968, filed on Oct. 9, 2003.

(51) Int. Cl.
*H01R 9/22* (2006.01)

(52) U.S. Cl. ..... 439/709

(58) Field of Classification Search ..... 439/835, 439/828, 883, 507, 729, 441
See application file for complete search history.

(56) References Cited

U.S. PATENT DOCUMENTS

| | | | | |
|---|---|---|---|---|
| 3,138,421 | A | 6/1964 | Locher et al. | |
| 4,989,118 | A | 1/1991 | Sorenson | |
| 5,639,270 | A | 6/1997 | Barbieri et al. | |
| 5,651,702 | A | 7/1997 | Hanning et al. | |
| 5,658,172 | A | 8/1997 | Schmidt et al. | |
| 5,741,142 | A | 4/1998 | Dux et al. | |
| 5,743,768 | A * | 4/1998 | Hohorst et al. | 439/723 |
| 5,853,304 | A | 12/1998 | Landreau et al. | |
| 5,860,837 | A * | 1/1999 | Bock et al. | 439/828 |
| 6,010,376 | A | 1/2000 | Kollmann | |
| 6,132,238 | A | 10/2000 | Hartmann et al. | |
| 6,155,890 | A | 12/2000 | Gerberding | |
| 6,270,384 | B1 * | 8/2001 | Jaag | 439/835 |
| 6,350,162 | B1 * | 2/2002 | Despang | 439/835 |
| 6,392,319 | B1 | 5/2002 | Zebermann et al. | |
| 6,506,071 | B1 | 1/2003 | Lange | |
| 2002/0155760 | A1 | 10/2002 | Brand et al. | |

OTHER PUBLICATIONS

Glenda B. Berman; Connectors and Interconnections Handbook; Mar.1990; pp. 145-149; vol. 1(Revised Edition; International Institute of Connector and Interconnection Technlogy, Inc. Deerfield, Il.

Marketing material; Spring-Clamp Connection; Jul. 8, 2003; www3.phoenixcontact.com (Continued)

*Primary Examiner*—Tulsidas C. Patel
*Assistant Examiner*—Phuongchi Nguyen
(74) *Attorney, Agent, or Firm*—Armstrong Teasdale LLP

(57) ABSTRACT

A terminal block includes a housing defining at least one bias compartment and at least one terminal compartment. A terminal plate is located within the housing and separates the bias compartment and the terminal compartment, and a bias element is positioned in the bias compartment. The bias element comprises a retainer portion extending through an opening in the terminal plate into the terminal compartment. The bias element is configured to retain a wire terminal to the terminal plate along a first direction and the terminal plate is configured to retain the wire terminal along a second direction when the wire terminal is received in through the retainer portion.

17 Claims, 2 Drawing Sheets

OTHER PUBLICATIONS

Marketing material; 4 Conductor Through Terminal Block; Jul. 8, 2003; www.wago.com.

Marketing material; Comb type Jumper Bar—2 Pole For Male and Female Connectors With Pine Spacings; Jul. 8, 2003; www.wago.com.

Marketing material; Adjacent Jumper; Jul. 8, 2003; www.wago.com.

Marketing material; Push-In Type Wire Jumper 60mm; Jul 8, 2003; www.wago.com.

* cited by examiner

LOCKING SPRING-CLAMP TERMINAL BLOCK AND METHOD FOR CONNECTING THE SAME

CROSS REFERENCE TO RELATED APPLICATIONS

This application claims the benefit of U.S. Provisional Application Ser. No. 60/509,968 filed Oct. 9, 2003, which is hereby incorporated by reference in its entirety.

BACKGROUND OF THE INVENTION

This invention relates generally to electrical connectors, and, more particularly, to terminal block devices and methods for connecting the same.

Terminal blocks for interconnecting wiring of electrical systems are known. In one type of terminal block, such as those commonly employed in European systems, wires are connected to the terminal block by inserting the ends of stripped wire into cage clamps or spring-clamps in the terminal block. A tool is used to depress the spring-clamp or cage clamp and create an opening between an edge of the clamp and an edge of a terminal plate in the terminal block. When the clamp is released, the clamp returns to its original position and presses the end of the wire against the terminal plate. While such clamp connections are convenient for attaching the wires to the block, they are susceptible to the wires being pulled from the clamp or jarred loose from the clamp.

Another type of terminal block, such as those commonly employed in North American systems, employs ring terminals for connecting wires to the block. A fastener, such as a binding head screw, is inserted through an opening in the block and also through the opening in the ring terminal to secure the wire to a pressure plate. While ring terminals and associated fasteners provide a more secure mechanical and electrical connection than cage clamps or spring-clamps, they can be difficult to install or remove when connecting and disconnecting wires to the block.

BRIEF DESCRIPTION OF THE INVENTION

According to an exemplary embodiment, a terminal block comprises a housing defining at least one bias compartment and at least one terminal compartment. A terminal plate is located within the housing and separates the bias compartment and the terminal compartment, and a bias element is positioned in the bias compartment. The bias element comprises a retainer portion extending through an opening in the terminal plate into the terminal compartment. The bias element is configured to retain a wire terminal to the terminal plate along a first direction and the terminal plate is configured to retain the wire terminal along a second direction when the wire terminal extended through the retainer portion.

Optionally, the wire terminal is a ring terminal, and the terminal plate comprises a lock protrusion. The lock protrusion extends into the terminal compartment and engages the ring terminal. The first and second directions are substantially perpendicular to one another to retain the wire terminal in vertical and horizontal directions. The bias element may comprise a D-shaped spring-clamp, and a shorting element may be mechanically and electrically connected to the terminal plate. The terminal plate and the bias element are configured to retain the wire terminal without external threaded fasteners.

According to another exemplary embodiment, a terminal block is provided. The terminal block comprises a housing defining at least one bias compartment and at least one terminal compartment separated by a terminal plate. A deflectable bias element is positioned in the bias compartment, and the bias element comprises a retainer portion extending through the terminal plate into the terminal compartment. The retainer portion is configured to provide normal force contact to the terminal plate when a wire terminal is received in the terminal compartment and engaged to the retainer portion. The terminal plate is configured to retain the wire terminal along an axis parallel to the terminal plate, thereby retaining the wire terminal to the terminal plate along two mutually perpendicular axes.

In still another embodiment, a terminal block is provided. The terminal block comprises a housing defining at least one bias compartment and at least one terminal compartment separated by a terminal plate. A deflectable bias element is positioned in the bias compartment, and the bias element is configured to provide normal force contact to the terminal plate when a wire terminal is received in the terminal compartment and engaged to the retainer portion. One of the terminal plate and the bias element comprises a protrusion extending therefrom, and the other of the terminal plate and the bias element comprises an opening configured to receive the protrusion and retain the wire terminal along an axis parallel to the terminal plate.

In yet another embodiment, a method of connecting a wire to a terminal block is provided. The terminal block includes a housing having a bias compartment and a terminal compartment separated by a terminal plate, and the bias element having a retainer portion extending through the terminal plate into the terminal compartment. The method comprises compressing the bias element to push the retaining portion further through the terminal plate and into the terminal compartment to position the retaining portion in the terminal compartment; inserting a wire terminal into the terminal compartment and through an opening in the retaining portion; and releasing the bias element, thereby clamping the wire terminal onto the terminal plate in a direction perpendicular to the terminal plate and engaging the wire terminal to the terminal plate to secure the wire terminal to the plate in a direction parallel to a surface of the plate without the use of threaded fasteners.

DETAILED DESCRIPTION OF THE INVENTION

Figure 1:
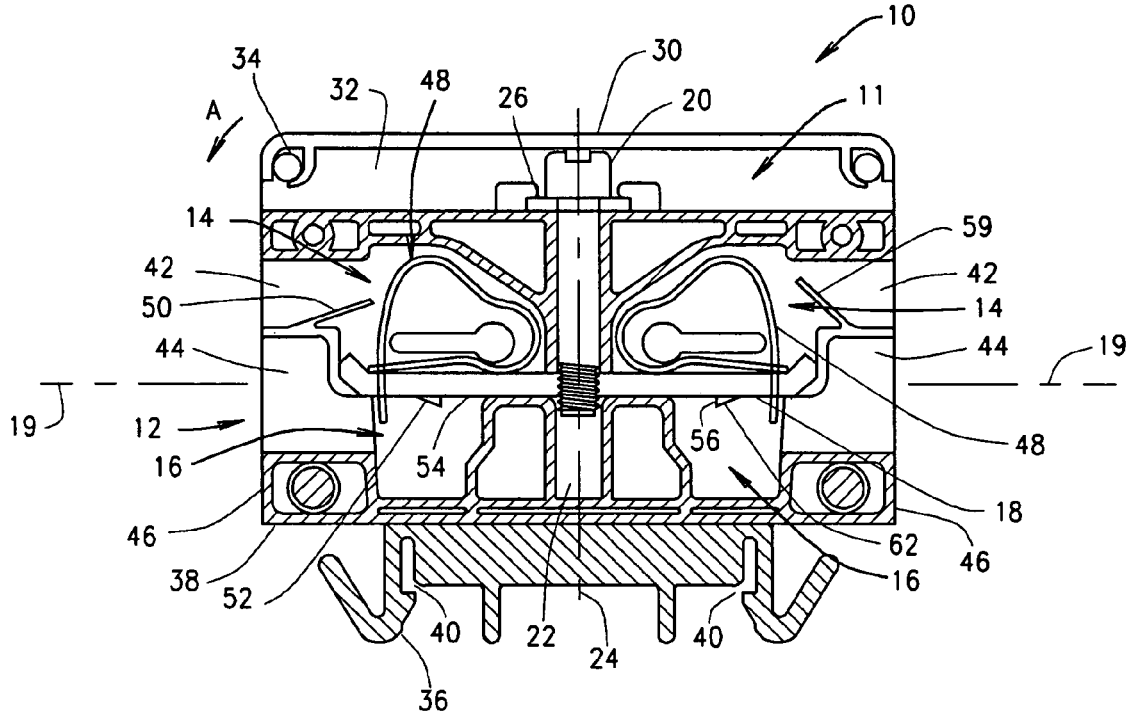
FIG. 1 is a sectional view of an exemplary terminal block.

FIG. 1 is a sectional view of an exemplary terminal block 10 including an insulative housing 12 which extends for an axial length oriented substantially perpendicular to the plane of the page of FIG. 1. Along its axial length, the housing 10 defines a number of compartment sections 11, one of which is illustrated in FIG. 1. Each compartment section 11 includes a pair of oppositely facing bias compartments 14 and a pair of oppositely facing terminal compartments 16.

A terminal plate 18 is seated horizontally within each compartment section 11 of the housing 10, and the terminal plate 18 separates the bias compartments 14 from the terminal compartments 16 along a horizontal axis 19. A shorting element 20 in the form of a shorting screw extends vertically through the housing 10 along an axis 24 in a centrally located bore 22 and separates the bias compartments 16 from one another. The shorting element 20 further extends through an opening in the center of the terminal plate 18 as illustrated in FIG. 1. The shorting element 20 is mechanically and electrically coupled to a shorting bus bar 26 which extends axially (i.e., substantially perpendicular to the plane of the page of FIG. 1) through the housing 10 over the various compartment sections 11. The bus bar 26 establishes an electrical path between adjacent terminal plates 18 of adjacent compartment sections 11 within the housing 12 via the shorting elements 20 of each of the compartment sections 11.

In an exemplary embodiment, the housing 10 includes a cover 30 situated over the bias compartments 14 and defining a compartment 32 in which a portion of the shorting element 20 and the bus bar 26 are located. The cover 30 is pivotally mounted on a hinge 34 and swings upward and away from the compartment 32 in the direction of arrow A about the hinge 34 to provide access to the compartment 32. The bus bar 26 and the shorting element 20 may be selectively installed or removed from the compartment 32 as desired to establish or prevent shorting contact between the terminal plates 18 of adjacent compartment sections 11 through the shorting elements 20 and the bus bar 26.

While the illustrated embodiment includes a shorting element 20 in the form of a screw engaging a bus bar 26, it is recognized that other shorting elements may be used in alternative embodiments in lieu of screws and a bus bar. For example, jumpers and the like may be used for shorting purposes in the terminal block 10.

In one embodiment, the housing 12 further includes a mounting element 36 depending downwardly from a lower edge 38 of the compartment section 11. The mounting element 36 is integrally formed with the housing 10 and is configured for connection to a DIN rail (not shown). A slot 40 is formed in the mounting element 36 to receive the rail with snap-fit engagement. In an alternative embodiment, other mounting features may be employed in lieu of DIN rail mounting, and the housing 12 may be modified accordingly to accommodate other mounting arrangements.

The bias compartments 14 and the terminal compartments 16 are arranged in pairs facing one another such that the compartment section 11 is bilaterally symmetrical about the vertical axis 24. That is, the left and right portions of the compartment section 11 are substantially identical but rotated substantially 180° relative to one another about the vertical axis 24. Each of the terminal compartments 16 are located adjacent and beneath the bias compartments 14. An opening 42 and 44 are provided in each of the respective bias compartments 14 and terminal compartments 16 and the openings 42, 44 extend through lateral side edges 46 of the housing 12.

Bias elements 48 are provided in each of the bias compartments 14. A portion of the bias elements 48 extend from the bias compartments 14 into the terminal compartments 16, and the bias elements 48 are adapted for locking engagement to a wire terminal. As explained below, the bias elements 48 may be compressed or deflected from a relaxed position as illustrated in FIG. 1 to an engagement position (shown in FIG. 3) wherein the wire terminal may be coupled to the respective bias element 48. When the bias elements 48 are released from the engagement position, the bias elements 48 return to the relaxed position and ensure contact between the wire terminal and the terminal plate 18.

Resilient barrier tabs 50 formed with the housing 12 extend at an angle from the housing 12 into the respective bias compartments 14. The barrier tabs 50 are movable between a normal position (shown on the right hand side of FIG. 1) substantially blocking the opening 42 into the respective bias compartment 14, and a deflected position (shown on the left hand side of FIG. 1) wherein a tool may be inserted into the respective bias compartment 14 for connection of a wire to the terminal plate 18 as described below.

The terminal plate 18 is provided in an illustrative embodiment with a pair of angled locking surfaces or protrusions 52 extending into the respective terminal compartments 16 from an underside of the terminal plate 18. The protrusions 52 may be formed, for example, from a stamped and bent portion of the plate 18 which is severed on three sides thereof. The severed tab is bent about the fourth attached side at an angle relative to the bottom surface 54 of the terminal plate 18 to form the protrusions 52. A leading edge of each of the protrusions 52 forms a catch surface 56 for retaining a wire terminal as described below. The protrusions 52 cooperate with the bias elements 48 to lock ring terminals (not shown in FIG. 1) to the terminal block in mechanical and electrical contact with the terminal plate 18 to connect wires to the terminal block 10.

In an alternative embodiment, the protrusions 52 may be formed with alternative fabrication techniques in lieu of stamping and forming as described above. Additionally, while the protrusions 52 are illustrated in FIG. 1 as having a substantially triangular profile, it is understood that the protrusions may be formed into a variety of alternative shapes without departing from the spirit of the invention.

Figure 2:
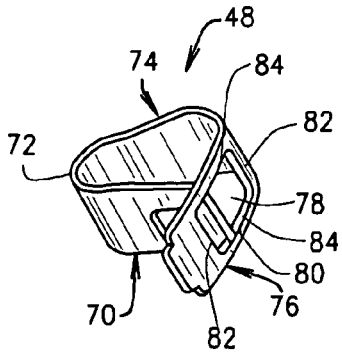
FIG. 2 is a perspective view of an exemplary bias element for the terminal block shown in FIG. 1.

FIG. 2 is a perspective view of an exemplary bias element 48 for the terminal block 10 (shown in FIG. 1). In one embodiment, the bias element 48 is a resilient, self-wrapping, D shaped spring-clamp which is commercially available from, for example, the Wago Corporation.

The bias element 48 includes a base section 70, a round portion 72 extending from the base portion 70, a flex portion 74 extending from the round portion 72, and a retaining portion 76 extending from the flex portion 74. The flex portion 74 has a partly convex and a partly concave profile, and the retaining portion 76 includes a substantially rectangular opening 78 extending therethrough which receives a leading end 80 of the base portion 70. The opening 78 includes end edges 82 and side edges 84 which are dimensioned to collectively form the opening 78 of a sufficient size to permit insertion of a wire terminal (not shown in FIG. 2) through the opening 78. The bias element 48 is positonable in the bias compartments 14 (shown in FIG. 1) of the compartment sections 11 of the terminal block 10 (shown in FIG. 1).

While one exemplary bias element 48 is illustrated, it is appreciated that differently configured bias elements may be employed in alternative embodiments as desired. A variety of alternatively shaped bias elements may be employed with the locking protrusions 52 (shown in FIG. 1) of the terminal plate 18 to securely retain a wire terminal to the terminal plate 18 of the terminal block 10 (shown in FIG. 1) with appropriate modification, as necessary, to the bias compartments 14 to accommodate alternative shapes of the bias elements.

Figure 3:
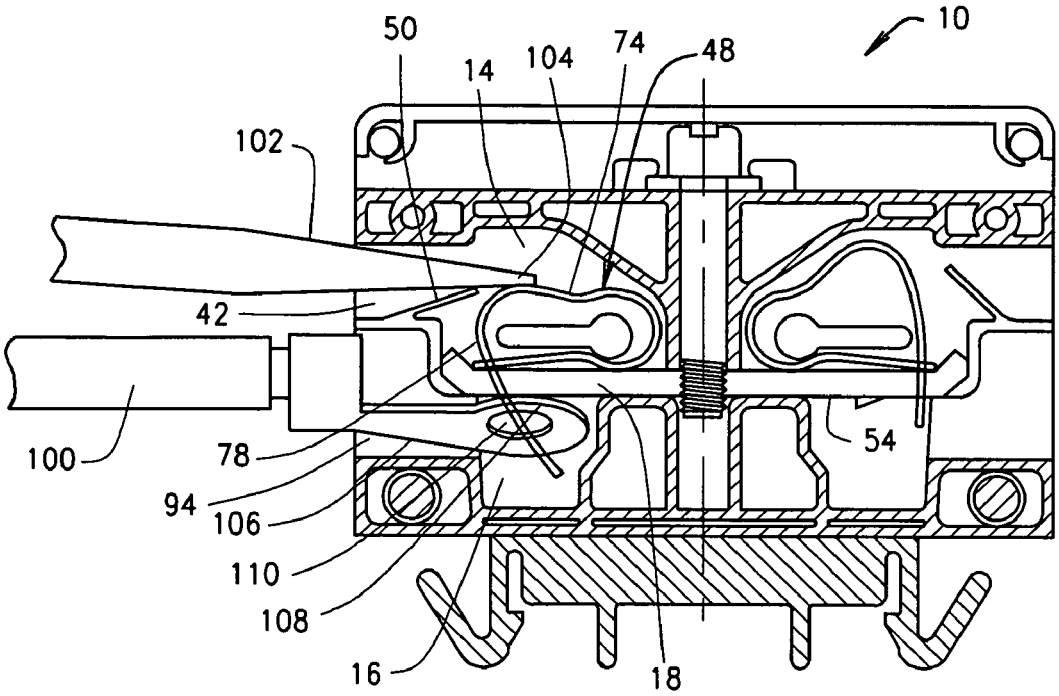
FIG. 3 is a sectional view of the terminal block shown in FIG. 1 as a wire is connected thereto.

FIG. 3 illustrates the terminal block 10 as a wire 100 is being attached thereto. A tool 102, such as a flat blade screwdriver, is inserted into the opening 42 in the left hand bias compartment 14. The tool 102 deflects that barrier tab 50 in the opening 42 and the tool 102 is inserted into the bias compartment 14 until an end 104 of the tool 102 contacts the flex portion 74 of the bias element 48. The tool 102 is pivoted within the bias compartment 14 to compress the flex portion 74 of the bias element 48 and deflect the retaining portion 76 through an opening in the terminal plate 18. The retaining portion 76 of the bias element 48 is therefore moved downward into the terminal compartment 16 to the engagement position. In the engagement position, the opening 78 (FIG. 2) of the retaining portion 76 is located within the terminal compartment 16 to receive the wire terminal.

In an exemplary embodiment, the wire 100 is mechanically and electrically connected, according to known methods and techniques, to a wire terminal in the form of a ring terminal 106. The ring terminal 106 is a substantially flat member having a round head 108 and a central opening 110 therein. Once the bias element 48 is depressed to the engagement position as illustrated in FIG. 3, the ring terminal 106 is inserted through the opening 44 into the terminal compartment 16 of the block 10. The ring terminal 106 is further passed through the opening 78 of the retainer portion 76 of the bias element 48 which is extended into the terminal compartment 16. Depending upon the relative sizes of the ring terminal 106 and the opening 78 (shown in FIG. 2) of the retaining portion 76 of the bias element 48, the ring terminal 106 may be rotated about the axis of the wire 100 to fit the ring terminal 106 through the opening 78 at an angle to the retaining portion 76 of the bias element 78.

Once the ring terminal 106 is inserted through the opening 78 in the bias element 48, the tool 102 is extracted from the bias compartment 14 and the bias element 48 is released. The bias element 48 retracts or returns from the deflected engagement position to its original relaxed (i.e., uncompressed) position shown in FIG. 1 in the bias compartment 14, thereby pulling the ring terminal 106 toward the bottom surface 54 of the terminal plate 18 and clamping the ring terminal 106 to the terminal plate 18. The ring terminal 106 is clamped in a position substantially parallel to and in contact with the terminal plate 118, and the opening 110 of the ring terminal 106 is positioned such that the protrusion 52 of the terminal plate 18 is located within the opening 110 of the ring terminal 106. As the bias element 48 returns to its original position, an edge of the opening 110 of the ring terminal 106 catches on the protrusion 52.

Figure 4:
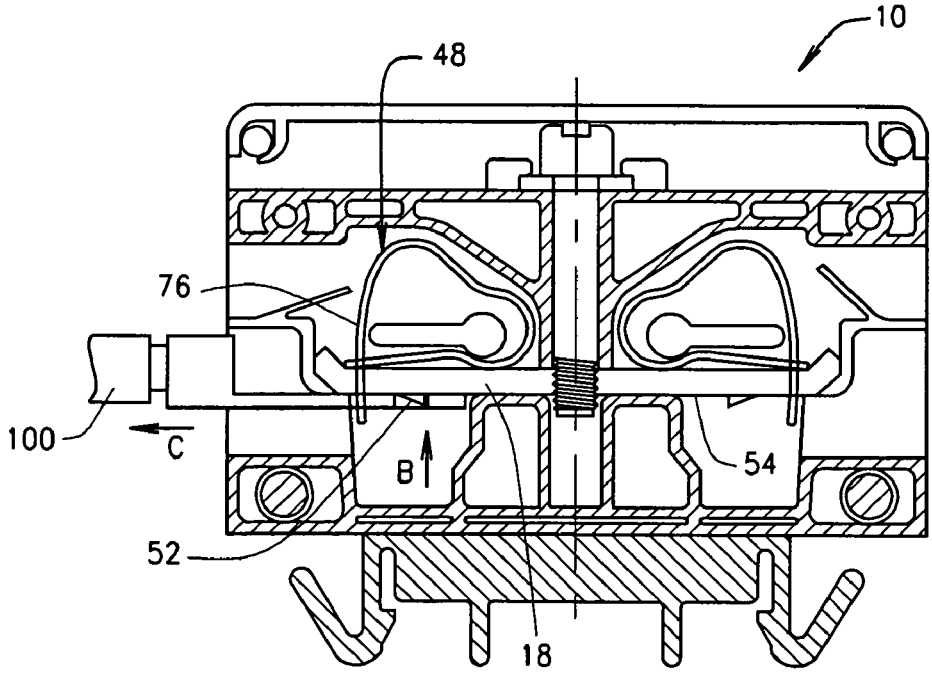
FIG. 4 is a sectional view of the terminal block shown in FIG. 1 with a wire retained thereto.

FIG. 4 illustrates the terminal block 10 with the ring terminal 106 locked thereto and the wire 100 securely mechanically and electrically connected to the terminal plate 18. The retaining portion 76 of the bias element 48 is pulled through the opening in the terminal plate 18 and back into the bias compartment 14, and therefore provides an upwardly directed clamping force on the ring terminal 106 which positions the ring terminal 106 is a substantially horizontal position beneath the terminal plate 18 and exerts an upward force or pressure on the ring terminal 106. A normal force is therefore created in a substantially vertical direction (i.e., in a direction of arrow B in FIG. 4) which ensures mechanical and electrical contact between the terminal plate 18 and the ring terminal 106.

The ring terminal 106 is further engaged to the protrusion 52 on the lower surface 54 of the terminal plate 18, thereby resisting horizontal movement (i.e., movement in a direction of arrow C in FIG. 4) of the ring terminal 106 in the terminal compartment 16 which otherwise may result in the wire terminal 106 from being pulled out of the retainer portion 76 of the bias element 48. Specifically, the protrusion 52 prevents the ring terminal 106 from being dislodged from the retaining plate 18 and the bias element 48 if a force is exerted on the wire 100 in a direction parallel to the surface of the terminal plate 18 as indicated by arrow C. Also, the protrusion 52 and the bias element 48 prevent the wire from jarring loose and breaking electrical contact with the terminal plate 18 during use.

The ring terminal 106 is therefore secured to the terminal plate 108 along two perpendicular axes, horizontal and vertical, in the terminal block 10 without providing external threaded fasteners of known terminal blocks. A secure mechanical and electrical connection to the terminal block 10 is therefore provided which combines the convenience of spring-clamps with the security and assurance of threaded fasteners.

The right hand portion of the terminal block 10 may be connected to another wire (not shown) according to the methodology described above. Namely, a tool 102 (shown in FIG. 3) is inserted into the opening 42 of the bias compartment 14 until the tool 102 engages the flex portion 74 of the bias element 48. Using the tool 102, the bias element 48 is compressed to push the retaining portion 76 through the terminal plate 18 and down into the terminal compartment 16 below the bias compartment 14. Once the retaining portion 78 of the bias element 48 is sufficiently positioned into the terminal compartment 16, the ring terminal 106 of a wire 100 is inserted through the opening 44, into the terminal compartment 16, and through the opening 78 in the retaining portion 76 of the bias element 48. The tool 102 is then extracted from the bias compartment 14 and the bias element 48 is released. When the bias element 48 is released, the retaining portion 76 is pulled back through the terminal plate 18 into the bias compartment 14, thereby clamping the ring terminal 106 in a substantially horizontal position in contact with the terminal plate 18. The release of the bias element 48 further causes the opening 78 of the ring terminal 106 to engage the protrusion 52 of the terminal plate 18 and lock the ring terminal 106 to the terminal plate 18.

From the locked position illustrated in FIG. 4, the tool 102 may be reinserted into the opening 42 into the bias compartment 14 to depress the bias element 48 so that the retaining portion 76 is sufficiently located in the terminal compartment 16 to dislodge the ring terminal 106 from the protrusion 52. Once dislodged, the ring terminal 106 may be pulled back through the opening 78 in the retainer portion 76 of the bias element 48 to remove the wire 100 from the terminal block 100.

While the terminal block 10 has been described for connection with a ring terminal 106, it is recognized that other shapes and configurations of wire terminals may be employed in lieu of ring terminals. The shape of the wire terminal is limited only by the size of the opening 78 in the retaining portion 76 of the bias element 48. A wire terminal of any shape that may be fitted through the opening 78 may be employed in further and/or alternative embodiments of the invention.

Additionally, while the invention has been described thus far with a protrusion 52 on the terminal plate 18 and an opening 110 in the ring terminal 106 which engage one another, it is contemplated that in an alternative embodiment the terminal plate 18 may be provided with an opening and the wire terminal may be provided with a catch surface to engage the opening of the terminal plate 18. The surfaces of the terminal plate 18 and the wire terminal need only have complementary locking features or engagement surfaces to securely retain the wire terminal to the terminal plate 18.

The terminal block 10 provides the convenience and versatility of spring-clamp connections while offering the security and assurance of threaded fasteners. Secure electrical connections to the terminal block 10 may be conveniently established while avoiding difficulties of known terminal blocks employing threaded fasteners to secure wires to the terminal block.

While the invention has been described in terms of various specific embodiments, those skilled in the art will recognize that the invention can be practiced with modification within the spirit and scope of the claims.

What is claimed is:

1. A terminal block comprising:

a housing defining at least one bias compartment and at least one terminal compartment;

a terminal plate within said housing and separating said bias compartment and said terminal compartment; and a bias element positioned in said bias compartment, said bias element comprising a retainer portion extending through an opening in said terminal plate into said terminal compartment;

wherein said bias element retains a ring terminal to the terminal plate along a first direction and wherein said terminal plate retains the-ring terminal along a second direction when the wire terminal is received in through the retainer portion;

wherein said terminal plate comprises a lock protrusion defining a catch surface extending therefrom, said lock protrusion retaining the ring terminal to said terminal plate when said bias element is relaxed.

2. A wire terminal in accordance with claim 1 wherein said bias element is deflectable within said bias compartment to extend said retainer portion further into the terminal compartment to receive the ring terminal.

3. A terminal block in accordance with claim 1 wherein said retainer portion receives the ring terminal through an opening therein.

4. A terminal block in accordance with claim 1 wherein said retainer portion comprises an opening extending therethrough, said opening located in said bias compartment when said bias element is in a relaxed position, and said opening located in said terminal compartment when said bias element is deflected.

5. A terminal block in accordance with claim 1 wherein said retainer portion includes an opening dimensioned to receive the wire terminal when said bias element is deflected, and said bias element is configured to retract and clamp the wire terminal to said terminal plate when said bias element is released.

6. A terminal block in accordance with claim 1 wherein said lock protrusion extends into said terminal compartment.

7. A terminal block in accordance with claim 1 wherein said first and second directions are substantially perpendicular to one another.

8. A terminal block in accordance with claim 1 wherein said bias element comprises a D-shaped spring-clamp.

9. A terminal block in accordance with claim 1 further comprising a shorting element mechanically and electrically connected to said terminal plate.

10. A tenninal block comprising:

a housing defining at least one bias compartment and at least one terminal compartment separated by a terminal plate; and a deflectable bias element positioned in said bias compartment, said bias element comprising a retainer portion extending through said terminal plate into said terminal compartment, said retainer portion configured to provide normal force contact to said terminal plate when a wire terminal is received in said terminal compartment and engaged to the retainer portion; and said terminal plate being configured to retain the wire terminal along an axis parallel to said terminal plate, thereby retaining said wire terminal to the terminal plate along two mutually perpendicular axes, wherein the wire terminal is a ring terminal inserted through an opening in said retainer portion, said terminal plate including a protrusion extending into said terminal compartment to engage said ring terminal.

11. A terminal block in accordance with claim 10 wherein said retainer portion comprises an opening extending therethrough, said opening located in said bias compartment when said bias element is in a relaxed position, and said opening located in said terminal compartment when said bias element is deflected.

12. A terminal block in accordance with claim 10 wherein said retainer portion is configured to receive the wire terminal when inserted into said terminal compartment when said bias element is deflected, said bias element configured to retract and clamp the wire terminal to said terminal plate.

13. A terminal block in accordance with claim 10 wherein bias element comprises a D-shaped spring-clamp.

14. A terminal block in accordance with claim 10 further comprising a shorting element mechanically and electrically connected to said terminal plate.

15. A terminal block comprising:

a housing defining at least one bias compartment and at least one terminal compartment separated by a terminal plate; and a deflectable bias element positioned in said bias compartment, said bias element configured to provide normal force contact to said terminal plate when a ring terminal is received in said terminal compartment and engaged to the retainer portion; and one of said terminal plate and said bias element comprising a locking protrusion extending at an angle therefrom, the protrusion including a leading edge defining a catch surface, and the other of said terminal plate and said bias element comprising an opening configured to receive said catch surface and retain the ring terminal along an axis parallel to said terminal plate.

16. A terminal block in accordance with claim 15 wherein bias element comprises a D-shaped spring-clamp.

17. A method of connecting a wire to a terminal block, the terminal block including a housing having a bias compartment and a terminal compartment separated by a terminal plate, the bias element having a retainer portion extending through the terminal plate into the terminal compartment, the terminal plate having a lock protrusion defining a catch surface extending therefrom, said method comprising:

compressing the bias element to push the retaining portion further through the terminal plate and into the terminal compartment to position the retaining portion in the terminal compartment;

inserting a ring terminal into the terminal compartment and through an opening in the retaining portion; and releasing the bias element, thereby clamping the ring terminal onto the terminal plate in a direction perpendicular to the terminal plate and engaging the ring terminal to the lock protrusion in the terminal plate to secure the wire terminal to the plate in a direction parallel to a surface of the plate without the use of threaded fasteners.

* * * * *